US007379523B2

(12) United States Patent
Ishida

(10) Patent No.: US 7,379,523 B2
(45) Date of Patent: May 27, 2008

(54) ELECTROMAGNETIC COUNTER WITH BUILT-IN ILLUMINATION MEANS

(75) Inventor: Noriyuki Ishida, Tokyo (JP)

(73) Assignees: Contex Corporation, Tachikawa-shi, Tokyo (JP); Tokyo Keisu Industry Co., Ltd., Tokyo (JP)

( * ) Notice: Subject to any disclaimer, the term of this patent is extended or adjusted under 35 U.S.C. 154(b) by 201 days.

(21) Appl. No.: 11/476,827

(22) Filed: Jun. 29, 2006

(65) Prior Publication Data

US 2007/0001706 A1 Jan. 4, 2007

(30) Foreign Application Priority Data

Jun. 30, 2005 (JP) ..... 2005-192225

(51) Int. Cl.
*G06M 1/10* (2006.01)

(52) U.S. Cl. ..... 377/82; 377/89; 324/244.1; 324/260

(58) Field of Classification Search ..... 377/13, 377/30, 87, 82, 89
See application file for complete search history.

(56) References Cited

U.S. PATENT DOCUMENTS 3,814,908 A * 6/1974 Wakabayashi ..... 377/87
5,010,334 A * 4/1991 Ponzio ..... 340/870.28
5,578,807 A * 11/1996 Tsukakoshi ..... 235/95 R
6,859,510 B1 * 2/2005 Ishida ..... 377/82

* cited by examiner

*Primary Examiner*—Tuan T Lam
(74) *Attorney, Agent, or Firm*—Manabu Kanesaka

(57) ABSTRACT

An electromagnetic counter includes an electromagnetic counting mechanism in a frame, a plurality of number wheels at least one of which is configured to rotate through a predetermined angle in response to rotation of an electromagnetically motivated anchor, wherein each of the number wheels is disposed proximate a window provided in the front of a frame enclosing cover to form a readable display section. A mounting board supports a light emitting diode for illuminating the display section, and a wiring pattern that supplies electrical power to the light emitting diode. A reflective surface is provided on at least one of an internal surface of the cover member to reflect light from the light emitting diode toward the numbered wheels, the periphery of one or more of the numbered wheels, and indicia formed in the numbered wheels, to render the number wheels readily readable when illuminated by the light emitting diode.

12 Claims, 7 Drawing Sheets

ELECTROMAGNETIC COUNTER WITH BUILT-IN ILLUMINATION MEANS

BACKGROUND OF THE INVENTION AND RELATED ART STATEMENT

The present invention relates to an electromagnetic counter such as that which is installed in various types of precision equipment such as gaming machines, copiers and printers for example, and more specifically to an improvement in an illumination arrangement for such an electromagnetic counter.

As described in Japanese Unexamined Patent Publication No. 57-93487, a known example of an electromagnetic counting mechanism is provided with an electromagnet, an anchor rotated by magnetization and demagnetization of the electromagnet, a lowest digit number wheel which is formed on its side with a ratchet gear that engages with a tab formed on the end of the anchor, and a predetermined number of additional digit number wheels having transmission gears formed on their sides, and pinions which are operatively interposed between these number wheels and which operatively interconnect the transmission gears.

In addition, this electromagnetic counting mechanism normally exhibits dust resistance via its disposition within a case so as to prevent obstruction of the rotation of the anchor due to adherence of iron filings or the like which are produced by the iron core magnetized by the electromagnet. The case may have, for example, a frame member, in which the electromagnet, anchor and number wheels are disposed at predetermined locations, and can be covered with a box-shaped cover member.

In this manner, an electromagnetic counter housing an electromagnetic counting mechanism facilitates handling and installation as a unit. However, it is often incorporated in various types of precision equipment such as gaming machines, copying machines or printers, which count, for example, the number of coins or number of pieces of paper fed, and thus frequently installed inside the aforementioned precision equipment, a problem arises that as the interior of the precision equipment has a complex structure and is dark, and the counter is not provided with a light emitting function, there are cases wherein it is difficult to read the values displayed on the counter. In such cases, there is no choice but to perform the bothersome task of reading the values by illuminating the inside of the precision equipment with a flashlight or the like.

In order to resolve such shortcomings, although the installation of a separate illumination lamp that illuminates the number wheels inside the precision equipment or the incorporation of a miniature light bulb inside the counter has been considered, due to the recent prominent trend of reducing the size of the precision equipment in which electromagnetic counters are installed, electromagnetic counters are also becoming increasingly small, thereby making it extremely difficult to install an illumination lamp either inside the precision equipment or inside the case of an electromagnetic counter. In addition, even if a confined space was secured and a miniature light bulb was installed therein, since the illumination service life of a miniature light bulb is short due to the use of a filament for the light source, it becomes necessary to periodically replace the light bulb, thereby resulting in the problems of bothersome maintenance work and its accompanying cost due to the confined installation space.

In addition, in the case of an electromagnetic counter of the type in which an electromagnetic, anchor and number wheels are housed within a case in which a cover member is fixed to a frame member, since replacement of the light bulb is essentially impossible, the problem arises in which it becomes necessary to replace the entire electromagnetic counter.

In order to solve these problems, the entity to which the instant application is assigned, previously filed patent for a novel electromagnetic counter having a built-in illumination means that can be housed in an extremely confined space within a compact electromagnetic counter, that requires hardly any maintenance and that is inexpensive (see Japanese Patent Application No. 2004-26803).

Irrespective of the improvements which are achieved by the arrangement disclosed in the above mentioned Japanese Patent Application No. 2004-26803, an examination of the technical contents of the electromagnetic counter with a built-in illumination means previously proposed by the present applicant revealed that there was still room for improvement with respect to the following points.

Namely, although the previously proposed electromagnetic counter is inserted into an enclosure such as a box-shaped cover member, and a frame member provided with an electromagnetic counting mechanism composed of an electromagnet, anchor, number wheels etc., and disposes a flexible board, on which is mounted a light emitting diode for illuminating the number wheels, in a confined space formed between the frame member and cover member, there is the risk that the mounted light emitting diode will provide insufficient illumination effects if only one or two used, while the mounting of a large number of light emitting diodes leads to increased costs. In addition, there are numerous cases in which it is difficult to mount a large number of light emitting diodes in light of the amount of space which is available.

In consideration of the circumstances of the prior art as described above, the object of the present invention is to further improve upon the previously proposed electromagnetic counter having a built-in illumination means that can be housed in an extremely confined space within a compact electromagnetic counter, requires hardly any maintenance and is inexpensive, by providing a novel electromagnetic counter with a built-in illumination means capable of obtaining efficient illumination effects using one or a few light emitting diodes.

SUMMARY OF THE INVENTION

In order to achieve the aforementioned object, a first aspect of the invention resides in an electromagnetic counter with built-in illumination comprising: an electromagnetic counting mechanism in a frame member, the electromagnetic counting mechanism being provided with an electromagnet, an anchor that is rotated by magnetization and demagnetization of the electromagnet, and a plurality of number wheels at least one of which is configured to rotate through a predetermined angle in response to rotation of the anchor, wherein each of the number wheels is exposed to a window provided in the front of a frame enclosing cover member so that a count displayed by each number wheel is visible through the window; a mounting board on which a light emitting diode for illuminating the display section, is mounted, and on which a wiring pattern is formed that supplies electrical power to the light emitting diode, wherein the mounting board is arranged in a space between the frame member and the cover member, and wherein the light emitting diode is positioned in the vicinity of the number wheels; and a reflective surface (reflecting means/reflector)

to render the numbered wheels readily readable when illuminated by the light emitting diode, the reflective surface being provided on at least one of: an internal surface of the cover member and configured with respect to the window of the cover member to reflect light from the light emitting diode toward the numbered wheels, the periphery of one or more of the numbered wheels, and indicia formed in the numbered wheels.

In accordance with this aspect of the invention, the aforementioned board is advantageously disposed so that a light emitting diode is positioned approximately at the center of each row of the number wheels and is achieved by mounting a single light emitting diode on the end of the aforementioned mounting board and enabling reduced costs and improved illumination efficiency. In this case, the reflecting means or reflector, is advantageously formed at a location that allows light from the light emitting diode to be efficiently reflected and illuminate each number wheel. This reflector, in at least one embodiment is arranged in a location opposite that in which the aforementioned light emitting diode is disposed. For example, in the case the light emitting diode is disposed beneath a window on the inside of the cover member, the reflecting means is provided above the window on the inside of the cover member.

However, the present invention is, of course, not limited to just this particular configuration and may encompass an arrangement wherein two or more light emitting diodes are used, and/or the reflecting means may be provided inside the cover member at its four corners.

In this disclosure, the location around the window inside the cover member refers to a surface around the aforementioned window inside the cover member, namely the front of the cover member where the window is formed inside the cover member, its surrounding upper surface, lower surface, right or left side or a gap between these surfaces and each number wheel.

An example of the aforementioned reflecting surface of reflecting means/reflector, is a reflecting plate provided on an internal surface around the aforementioned window inside the aforementioned cover member. Examples of reflecting plates include a metal plate having high reflection characteristics such as a stainless steel, aluminum, nickel, glossy chrome or gold plate, a plastic plate composed of a white or other bright colored/reflective resin having high luminosity (high reflection efficiency), or a mirror.

One example of the aforementioned reflecting means is a metal-plated film or reflective coated film formed on a surface around the aforementioned window inside the aforementioned cover member. Examples of metal-plated films include an aluminum-plated film, nickel-plated film, glossy chrome-plated film and gold-plated film having high reflection efficiency. Examples of reflective coated films include white or other colored resin coating having high luminosity, mirrored surface ink containing a glossy pigment such as aluminum pigment, and other reflective coated films formed with a known coating capable of forming a reflective coated film.

In this case, since a reflecting plate is not required as the reflector, in addition to being able to reduce the number of parts, assembly work of the electromagnetic counter is simplified, thereby offering the advantage of leading to reduced costs.

In another example of the aforementioned reflecting means, the aforementioned cover member is molded from a metal or plastic having high reflection characteristics, and the surface around the window inside the cover member is formed to function as the aforementioned reflecting means. In this case, examples of materials molded into the cover member include metal materials such as stainless steel, aluminum, nickel, glossy chrome and gold, and white or other colored resin materials having high luminosity (high reflection characteristics). In addition, in this instance, since the periphery of the aforementioned window outside the cover member is also highly reflective, it is within the scope of the invention, depending on the conditions of use, there is the risk of the external reflection rendering it difficult to read the count displayed by each number wheel. Accordingly, the periphery of the aforementioned window outside the cover member is, in this instance, advantageously colored black and/or provided with a matte finish or the like in a manner which attenuates the external reflection.

In this case again, since a reflecting plate is not required, the number of parts can be reduced, and since it is not necessary to form a plated film or coated film, the assembly work of the electromagnetic counter is simplified, thereby offering the advantage of being able to expect a considerable reduction in costs.

In this manner, by providing a reflecting means that reflects light of a light emitting diode towards each number wheel at a location around a window inside a cover member, the light from the light emitting diode can be reflected by the reflecting means to efficiently illuminate each of the number wheels. Accordingly, even if the number of light emitting diodes mounted is one or limited to 2 or 3, the count displayed by each number wheel can be read easily. In addition, even if a light emitting diode is used that has a relatively low luminance, illumination can be obtained that is equivalent to the case of using a light emitting diode having high luminance, thereby offering numerous advantages including being able to reduce costs incurred with respect the light emitting diode.

An example of a structure/arrangement capable of imparting reflectivity to each number on the peripheral surface of the number wheels consists of forming each number or indicia using a metal foil having a high reflectivity such as aluminum or gold, metallic ink containing a brightening pigment, or a synthetic resin coating having superior reflectivity. More specifically, numbers made of metal foil may be adhered to the peripheral surface of the number wheels by stamping out each number and/or by pressing the metal foil onto the peripheral surface (surface where each number/indicia is displayed) of the number wheels, by printing with metallic ink or synthetic resin coating, or by forming each number by heat treatment such as baking or the like.

Another example of imparting reflectivity around each number on the peripheral surface of the number wheels consists of forming the periphery per se of each number using the aforementioned metal foil, metallic ink or synthetic resin coating and leaving each number/indicia untreated and therefore less reflective than its surroundings.

According to the above arrangements, since each number or the periphery of each number secondarily emits light by reflecting light from a light emitting diode, the numbers displayed by each number wheel appear brighter and more distinct. Accordingly, even if the number of light emitting diodes mounted is reduced (e.g. 1 or 2 or 3), the count displayed by each number wheel can be read easily. In addition, even if a light emitting diode is used that has a relatively low luminance, illumination can be obtained that is equivalent to the case of using a light emitting diode having high luminance, thereby offering numerous advantages including being able to reduce costs incurred for the light emitting diode.

Furthermore, according to the embodiments of the present invention, the aforementioned board is preferably disposed so that a light emitting diode is positioned roughly in the center of each of the row of number by mounting a single light emitting diode on the end of the aforementioned mounting board to achieve cost and illumination efficiency.

In addition, with the embodiments of the present invention, the use of both the aforementioned reflecting means and a structure/arrangement that imparts reflectivity to each number is advantageous since it makes the aforementioned effects even more effective.

Further, in an electromagnetic counter with a built-in illumination according to embodiments of the present invention, the aforementioned cover member has a rear opening for inserting the aforementioned frame member provided with the aforementioned electromagnetic counting mechanism into the cover member. This aforementioned frame member has a U-shape when viewed from above in which side sections are provided extending to the left and right edges of a back section that covers the aforementioned rear opening. Accordingly, the electromagnetic counting mechanism is disposed in the space enclosed by this back section and left and right side sections. The electromagnet connection terminals that supply electrical power to the aforementioned electromagnet, and light emitting diode connection terminals on the end of the aforementioned wiring pattern in the aforementioned mounting board, are as such as to protrude to the rear of the aforementioned cover member through the aforementioned back section.

This type of electromagnetic counter with a built-in illumination means can be easily installed on the surface of an installation board (mother board) on which a wiring pattern is formed. That is to say, together with inserting electromagnet connection terminals and light emitting diode connection terminals into through holes provided in the wiring pattern of the aforementioned installation board, by soldering portions that protrude to the rear of the aforementioned installation board to the connection terminals of the wiring pattern of the installation board, the electromagnetic counter with built-in illumination means can be easily attached to the surface of the installation board. This soldering work can be easily automated using an automated soldering system for flow soldering, thereby greatly contributing to simplification, increased speed and reduced costs of electromagnetic counter assembly and installation work. In addition, since soldering can be performed without human intervention, there is also the advantage of stable quality.

Further, although the aforementioned mounting board may be a board made of a film such as a flexible board in this case, together with using a rectangular, a hard board composed of a hard material such as glass epoxy resin and using the end of that board as the light emitting diode mounting site, it is advantageous in some embodiments to form the mounting board to have a rectangular shape in which projections serving as light emitting diode connection terminals are integrally provided on the left and right edges of the rear end. This can be achieved by, for example, stamping out the space between the left and right projections with a press or the like so that the projections on which the light emitting diode connection terminals are formed are integrally provided on the left and right edges of the rear end. A light emitting diode mounted on the end and a wiring pattern for supplying electrical power to the light emitting diode across the left and right projections formed on the rear end can be easily formed using a known technique such as etching on the surface of a mounting board employing this type of construction.

Furthermore, in accordance with embodiments of the present invention, the aforementioned mounting board (flexible board or hard board) may also be adhered to the inside of a frame member or cover member, and in this case, illumination means assembly work and electromagnetic counter assembly work can be carried out more easily.

In addition, in some embodiments of the present invention, the aforementioned light emitting diode can be a multicolored light emitting diode.

In accordance with the embodiments of the present invention, although the number of number wheels is not necessarily limited, since an arrangement is typically employed wherein it is composed of a lowest digit number wheel that rotates through a predetermined angle in response to the rotation of an anchor, a predetermined number of subsequent digit number wheels in which transmission gears are formed on their sides, and pinions that increase the place interposed between these number wheels, it goes without saying that such an arrangement is included within the scope of the present invention.

As a result of the above described type of construction, since an electromagnetic counter with built-in illumination according to embodiments of the present invention is provided with an illumination arrangement in the form of a light emitting diode, despite being small and easily installed even within the confined space inside precision equipment, it has similar effects to the previous application (viz., Japanese Patent Application No. 2004-26803 filed by the same entity as the instant application) in that it allows the count to be read easily, and offers easier maintenance and lower costs as compared with the case of using a miniature light bulb.

In addition, since a reflecting means/reflector that reflects light of a light emitting diode towards each number wheel, or a means that imparts reflectivity to or around each number wheel on the peripheral surface of a number wheel, the count displayed by each number wheel can be easily read by efficiently using the light produced by a small number of light emitting diodes. Accordingly, an electromagnetic counter with built-in illumination means can be advantageously provided at low costs while exhibiting low power consumption.

Further, since at least one embodiment of the invention can easily be attached to an installation board (e.g. a motherboard) by automated soldering, embodiments of the invention can be advantageously used in gaming equipment and other applications that require a large number of counters.

Moreover, since the color of the emitted light can be selected arbitrarily through the use of a multicolored light emitting diode, in the case of, for example, installing a plurality of electromagnetic counters to accommodate a plurality of counted elements, by changing the color of the emitted light for each electromagnetic counter, reading errors or the like, of each counted element can be attenuated.

DETAILED DESCRIPTION OF THE PREFERRED EMBODIMENTS

Although the following provides an explanation of exemplary embodiments of the present invention with reference to the drawings, the scope of the invention is not limited to these specific embodiments.

An electromagnetic counter with built-in illumination means A, shown in FIGS. 1(*a*) to 3, hereinafter referred to as "electromagnetic counter A", has a basic construction similar to the electromagnetic counter with built-in illumination means disclosed in the above mentioned previously proposed Japanese Patent Application No. 2004-26803, with the difference being that reflectivity is imparted to each of the numbers 0 to 9 on the peripheral surface of each number wheel 4 and 5. First, an explanation of the basic construction of electromagnetic counter A, is given.

Figure 1:
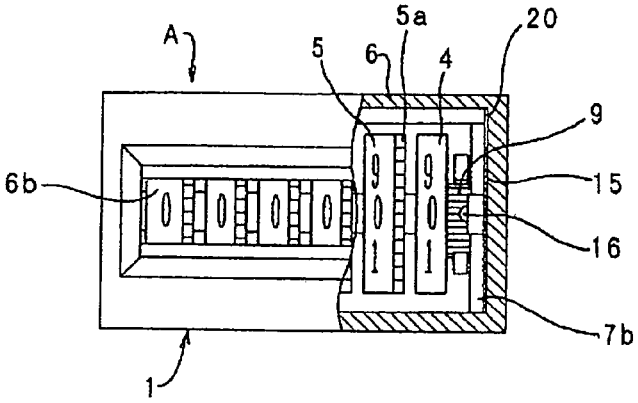
FIGS. 1(*a*), 1(*b*) and 1(*c*) show an example of an embodiment of an electromagnetic counter of the present invention, wherein FIG. 1(*a*) is a partial cutaway front view, FIG. 1(*b*) is a partial cutaway overhead view, and FIG. 1(*c*) is a cross-sectional view taken along line 1(*c*)-1(*c*) in FIG. 1(*b*).
Figure 1:
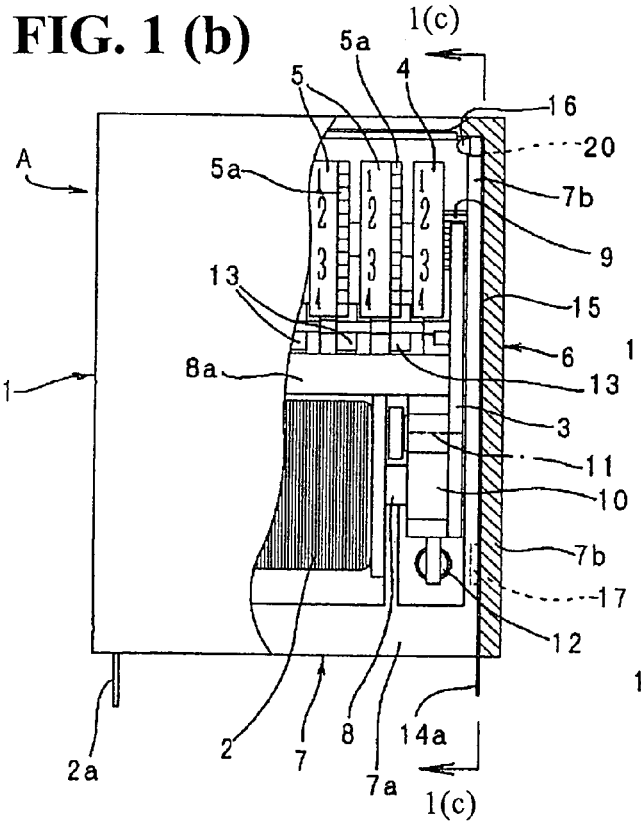
Figure 1:
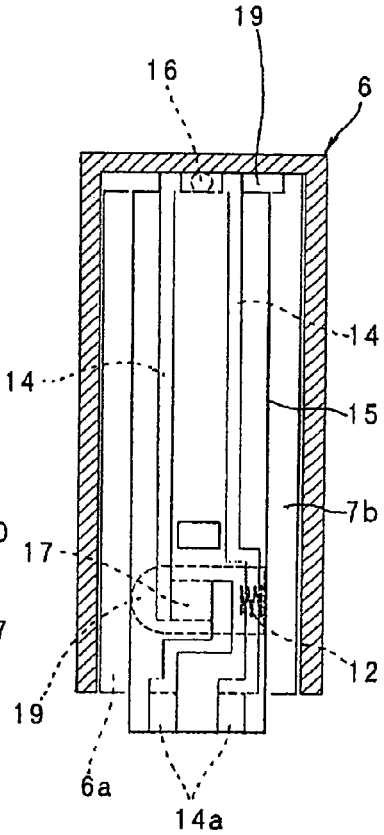

As shown in FIGS. 1(*a*) to 2(*b*), electromagnetic counter A is provided with an illumination means together with an electromagnet 2, an anchor 3, a lowest digit number wheel 4, upper or higher digit number wheels 5 within a case 1, and is arranged so that the counts displayed by each number wheel 4 and 5 are illuminated by the illumination means so that they can be easily read even in a dark environment.

Case 1 comprises an essentially box-shaped cover member 6, and a frame member 7, the periphery of which is covered by the cover member 6. In addition to being provided with an opening 6*a* serving as an insertion opening for frame member 7 in its rear side, cover member 6 is also provided with a window 6*b* serving as the counter display section in its front side. Frame member 7 has an essentially U-shape when viewed from above in which side sections 7*b* extend on the left and right sides of back section 7*a* that blocks the opening 6*a*.

An electromagnet 2, an anchor 3, a lowest digit number wheel 4, higher digit number wheels 5 are disposed between side sections 7*b* on the left and right sides of frame member 7 to comprise the electromagnetic counting mechanism.

The electromagnetic counting mechanism is constructed essentially in the same manner as conventional electromagnetic counters, and as a brief explanation of that mechanism, when current is supplied to electromagnet 2, an iron core 8 and an auxiliary iron core 8*a* are magnetized, a movable piece 10, which is unitarily integrated with the base end of anchor 3 provided with a tab on its end that meshes with ratchet gear 9, is attracted by iron core 8 and auxiliary iron core 8*a*, and anchor 3 rotates in the forward direction in opposition to a spring 12 centering around a rotation axis 11. On the other hand, when current to electromagnet 2 is interrupted, since iron core 8 and auxiliary iron core 8 are no longer magnetized, anchor 3 rotates in the reverse direction due to the force of spring 12. Namely, anchor 3 performs one reciprocating rotational movement as a result of the current to electromagnet 2 being switched on and off, and as a result of this single rotational movement, ratchet gear 9 rotates 36 degrees. Ratchet gear 9 is unitarily integrated with lowest digit number wheel 4, and lowest digit number wheel 4 also rotates 36 degrees accompanying rotation of ratchet gear 9.

Numbers from 0 to 9 are printed on the outer periphery of lowest digit number wheel 4 at 36 degree intervals, and lowest digit number wheel 4 rotates each time a pulse of signal current is applied to electromagnet 2. The upper or higher digit number wheels 5, which are installed in a row with lowest digit number wheel 4, have a transmission gear 5*a* on their sides, and a pinion 13 that increases the place is provided between each of the number wheels 4 and 5. When lowest digit number wheel 4 makes one rotation, pinion 13 also rotates, the next highest upper digit number wheel 5 rotates by 36 degrees, and when the first upper digit number wheel 5 makes one rotation, pinion 13 rotates and causes the next highest upper digit number wheel 5 to rotate by 36 degrees, thereby allowing the number of signals applied to display the count as a result of repeating the operation.

The illumination means has a light emitting diode 16 and a current limiting resistor 17 mounted on a mounting board. In this embodiment, the board is a flexible board 15 on which is formed printed wiring 14. This flexible board 15 is affixed with double-sided tape 18 to a side section 7*b* on the left or right side of frame member 7 (right side in FIG. 1(*a*)).

Notches 19, in which are housed light emitting diode 16 and current limiting resistor 17, are formed at suitable locations in side section 7*b* to which flexible board 15 is affixed, enabling the illumination means to be housed within confined space 20 between cover member 6 and frame member 7.

The end section of flexible board 15 is formed so as to be located to the outside of back section 7*a* of frame member 7, namely protruding to the outside of case 1 and towards the rear of cover member 6. In addition, end terminal sections (light emitting diode connection terminals) 14*a* of the printed wiring 14 are formed on its end. When a voltage is applied to the terminal sections 14*a*, current flows to light emitting diode 16 through current limiting resistor 17 causing it to illuminate. The light which is produced is radiated towards each of the number wheels 4 and 5 enabling the count to be read even in a dark environment.

Connection terminals 2*a* of electromagnet 2 (electromagnet connection terminals) are composed of metal rods, and protrude to the outside of case 1 by passing through back section 7*a* of frame member 7.

Figure 3:
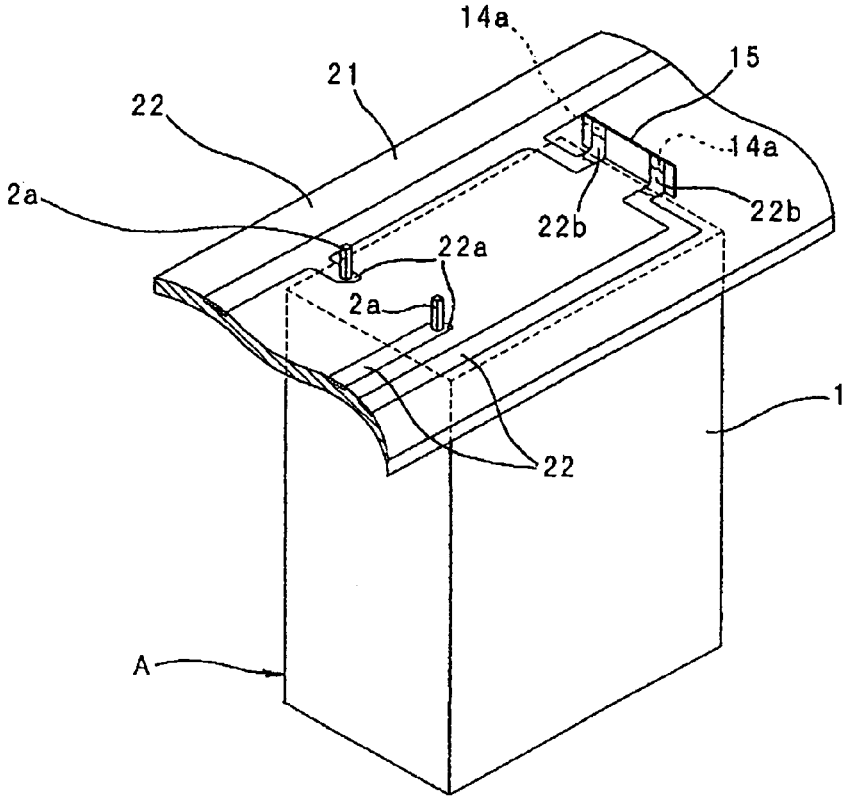
FIG. 3 is a perspective view showing the state in which the electromagnetic counter shown in FIGS. 1(*a*)-1(*c*) is fixed to an installation board.
Figure 4:
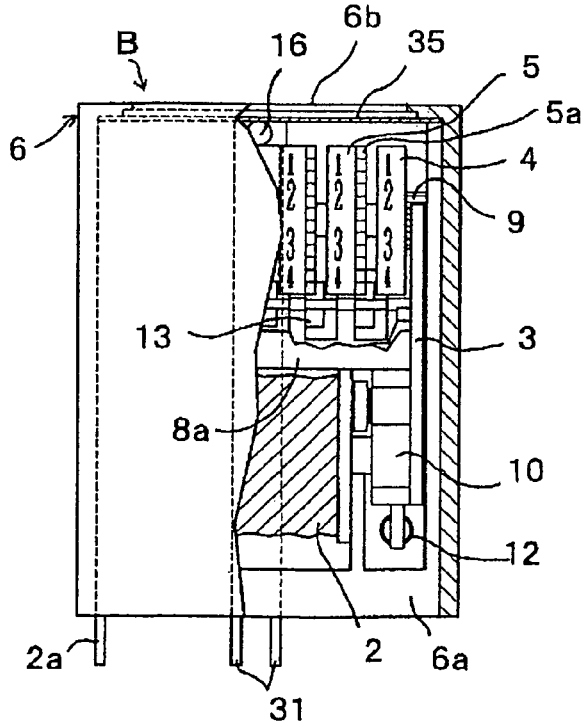
FIG. 4 is a partially cut-away view showing another embodiment of an electromagnetic counter according to the present invention illustrating constructional features of this arrangement.
Figure 5:
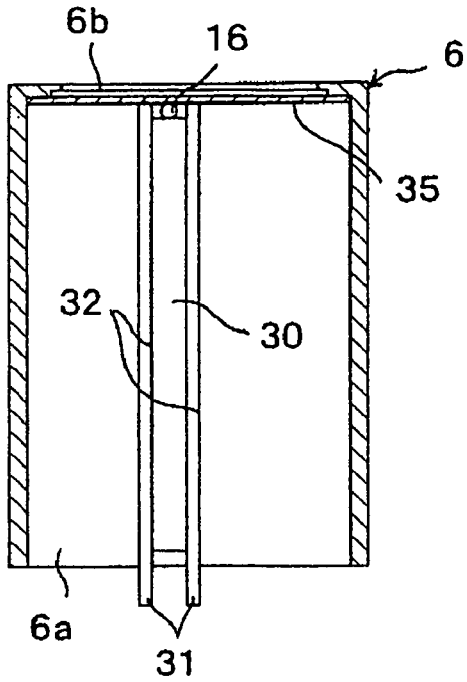
FIGS. 5(*a*) and 5(*b*) show the positional arrangement of a mounting board and light emitting diode in the electromagnetic counter shown in FIG. 4, wherein FIG. 5(*a*) is a transverse overhead view of the cover member, and FIG. 5(*b*) is a longitudinal overhead view of the cover member.
Figure 5:
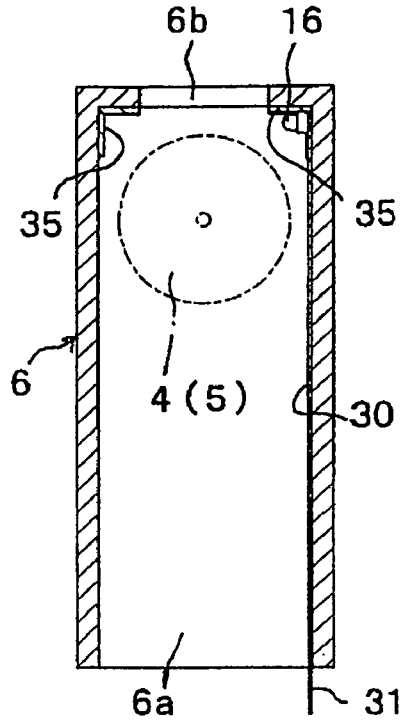
Figure 6:
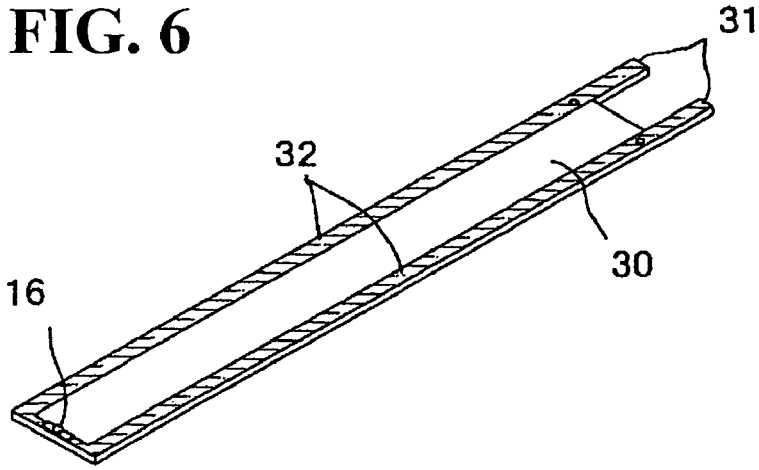
FIG. 6 is a perspective view of a mounting board in the electromagnetic counter shown in FIG. 4.
Figure 7:
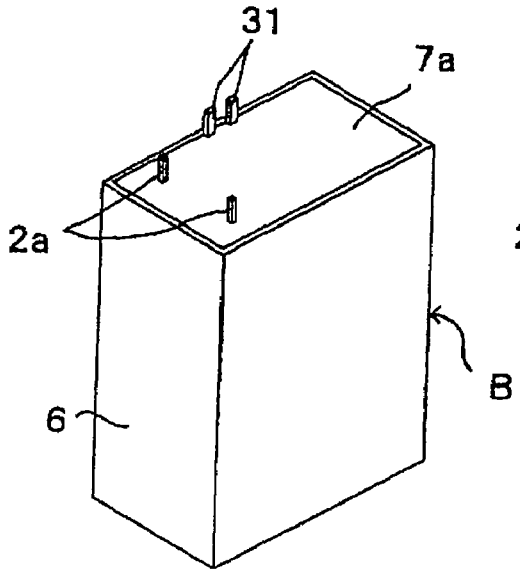
FIG. 7(*a*) is a perspective view of the electromagnetic counter shown in FIG. 4 as viewed from the back, while FIG. 7(*b*) is a perspective view of illustrating the state in which the same electromagnetic counter is fixed to an installation board.
Figure 7:
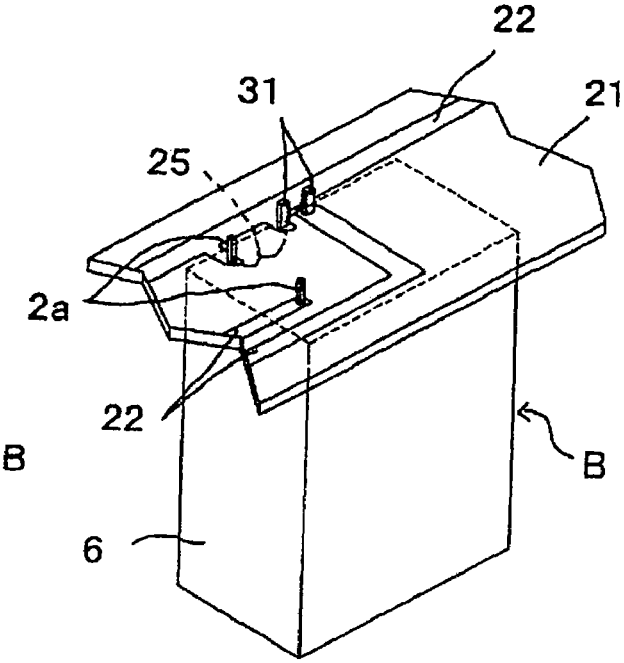

FIG. 3 shows the state in which electromagnetic counter A of the present embodiment is attached to an installation board (motherboard) 21 fixed to precision equipment or the like in which it is to be installed.

A wiring pattern 22 for supplying electrical power to the aforementioned electromagnet 2 and light emitting diode 16 is formed on an installation board 21, and inserts 22*a* into which connection terminals 2*a* of electromagnet 2 are inserted, and connectors 22*b* to which end terminal sections (light emitting diode connection terminals) 14*a* of flexible board 15 are connected, are formed at suitable locations of this wiring pattern 22.

As a result of soldering end terminal sections 14*a* to connectors 22*b*, and inserting connection terminals 2*a* of electromagnet 2 into inserts 22*a* followed by soldering, wiring work between wiring pattern 22 of installation board 21, electromagnet 2 and light emitting diode 16, and installation work for installing electromagnetic counter A, can be carried out in the same step, thereby making it possible to simplify the work.

Figure 2:
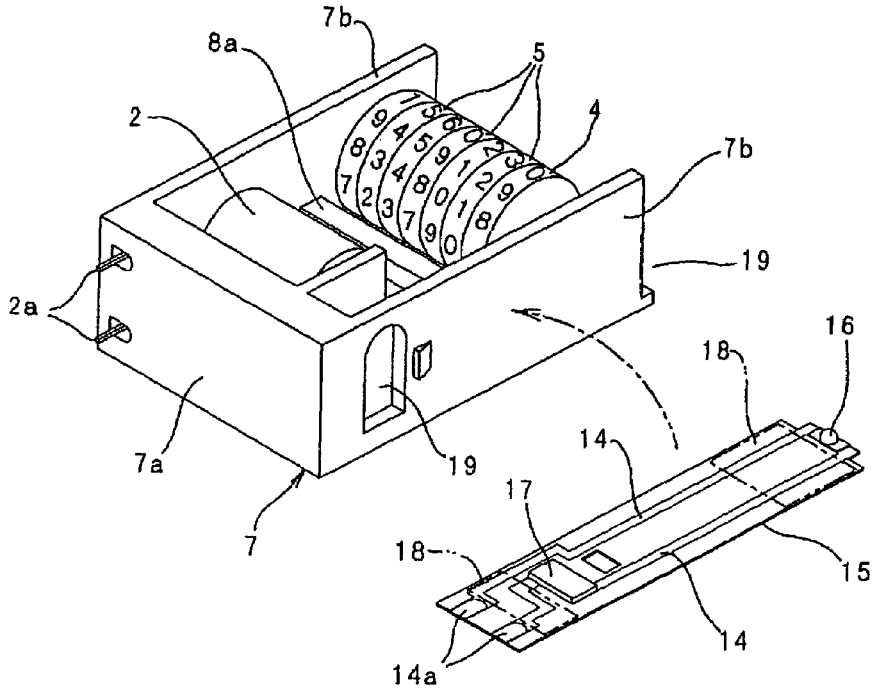
FIGS. 2(*a*) and 2(*b*) are perspective views, wherein FIG. 2(*a*) is a perspective view of the state in which a portion of the cover member and mounting board of the electromagnetic counter shown in FIGS. 1(*a*)-1(*c*) have been removed, while FIG. 2(*b*) is a perspective view showing the state prior to assembly of the cover member and frame member.
Figure 2:
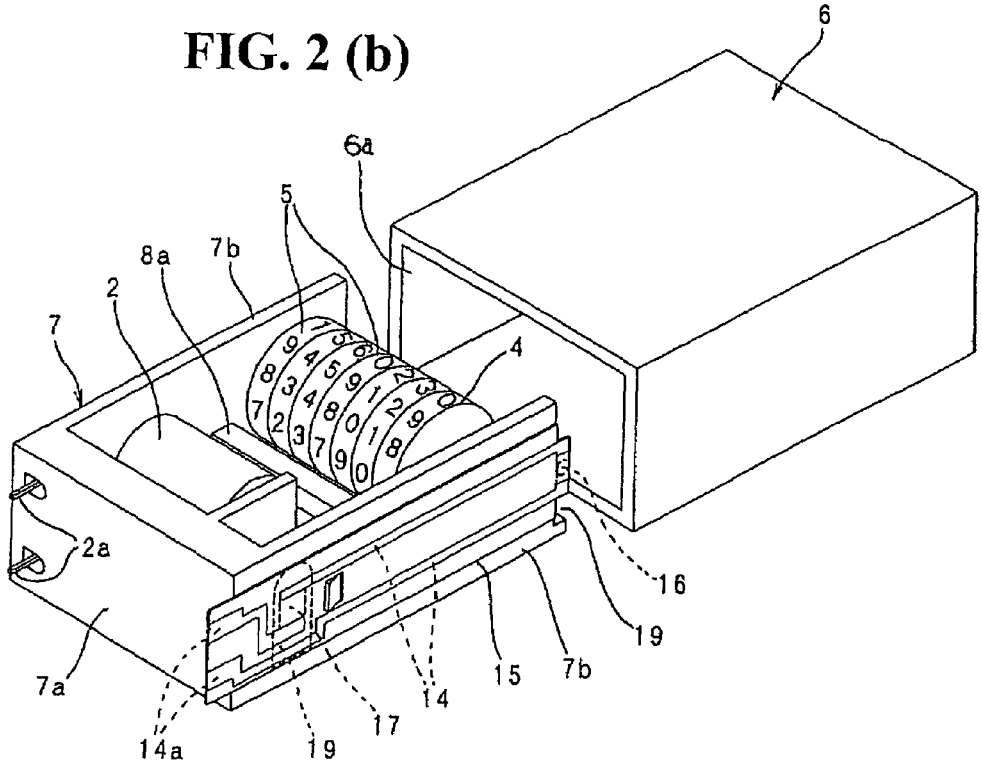

As shown in FIGS. 2(*a*) and 2(*b*) and other drawings, flexible board 15 is formed into an essentially rectangular shape capable of being affixed to side section 7*b* of frame member 7, and together with printed wiring board 14 being formed between light emitting diode 16 mounted on the leading end and end terminal sections 14*a* formed on the rear end, current limiting resistor 17 is mounted to an intermediate section.

Furthermore, flexible board 15 may also be a hard board composed of a hard material such as glass epoxy resin, and may be arranged so that the light emitting diode 16 is positioned in approximately the center of the row of the number wheels 4 and 5.

Together with comprising an electromagnetic counting mechanism by disposing in advance electromagnet 2, anchor 3, lowest digit number wheel 4 and upper digit number wheels 5 on frame member 7, electromagnetic counter A of the present embodiment as explained above is, in accordance with one embodiment of the invention, assembled by affixing flexible board 15, on which is mounted light emitting diode 16 and current limiting resistor 17, to side section 7*b* of frame member 7 with double-sided tape 18, housing light emitting diode 16 and current limiting resistor 17 in notches 19, and covering this frame member 7 with cover member 6.

Accordingly, flexible board 15, on which is mounted light emitting diode 16 and current limiting resistor 17, is housed within a confined space 20 between frame member 7 and cover member 6, and even if that space is reduced so that there is hardly any space for incorporating a miniature light bulb or the like, the count can be read easily even in dark locations via the provision of the illumination means. In addition, since the illumination means is composed of a light emitting diode 16, maintenance is not required and there is no effect on actual use even if case 1 is constructed so that it cannot be disassembled. Moreover, since installation in precision equipment can be carried out easily as previously described, an electromagnetic counter can be provided that is extremely useful for installing in compact gaming machines, copiers, printers and the like.

In accordance with embodiments of the present invention, electromagnetic counter A which is constructed in this manner can have improved illumination efficiency by imparting reflectivity to each of the numbers of 0 to 9 on the peripheral surface of each number wheel 4 and 5. More specifically, in this instance, each number 0 to 9 is formed at equal intervals on the peripheral surface of each number wheel by stamping out metal foil. Number wheels 4 and 5 produced in this manner have numbers on their peripheral surfaces that have been rendered reflective, and since each number reflects light from light emitting diode 16, each of the numbers 0 to 9 appear brighter and more distinct to the observer.

Accordingly, the count displayed by each number wheel 4 and 5 can be read easily even if there is only one light emitting diode 16 provided. In addition, even if the light emitting diode 16 that is used has low luminance as compared with brighter LED, the illumination that is obtained is comparable to the situation wherein a brighter more powerful LED is used, thereby making it possible to reduce costs incurred with respect to the light emitting diode which is used.

The following provides an explanation of an example of an electromagnetic counter with built-in illumination means provided with a reflecting means according to a second embodiment of the present invention illustrated in FIGS. 4 to 7. Here, some of the drawings and explanations that duplicate those constituents that are the same as electromagnetic counter A shown in FIGS. 1(*a*) to 3 are omitted, and the following description focuses only on the characteristics of the present embodiment.

An electromagnetic counter with built-in illumination means B according to this example (hereinafter referred to as "electromagnetic counter B") is constructed essentially in the same manner as the aforementioned electromagnetic counter A, at least with respect to the frame member 7, being installed with the aforementioned electromagnetic counting mechanism, being inserted through rear opening 6*a* of cover member 6, a display section being formed by disposing each number wheel 4 and 5 in the vicinity of window 6*b* in the front of the cover member 6, and a count displayed by each number wheel being read through window 6*b*.

In this example, a rectangular, hard mounting board 30 composed of glass epoxy resin is used as the mounting board on which light emitting diode 16 is mounted in lieu of the aforementioned flexible board. Projections 31 functioning as light emitting diode connection terminals are integrally provided on its rear end, and a wiring pattern 32 composed of a conducting metal such as copper foil is formed by etching and the like across light emitting diode 16 from these projections 31. Devices such as a current limiting resistor 17 which disposed at an intermediate section of wiring pattern 32, are not shown in the drawings for the sake of illustrative simplicity and clarity.

Although this mounting board 30 is disposed within a confined space formed inside cover member 6 between frame member 7 as in the previously described example, in this arrangement, mounting board 30 is attached to approximately the center of frame member 7 in the direction of width of so that light emitting diode 16 is located approximately in the center of the row of number wheels, thus causing light emitting diode 16 to be positioned in front of number wheel 5 located proximate the center of the row.

In addition, a reflecting means in the form of a reflecting plate 35, which reflects light of light emitting diode 16 towards each number wheel 4 and 5, is provided around window 6*b* on the inside of cover member 6, and more specifically, on the inside of the front, the inside of the top and the inside of the bottom of cover member 6 at sections in close proximity to window 6*b*.

Although reflecting plate 35 of this example comprises an extremely thin aluminum plate affixed to inside of the front, inside of the top and inside of the bottom of cover member 6 at sections in close proximity to window 6*b*, aluminum foil can also be affixed instead. In addition, a thin plate or foil of stainless steel or nickel or the like, or a white resin plate or the like, may alternatively be used.

Moreover, a metal-plated film or reflective coated film can also be formed as a reflecting means on the inside of the front, inside of the top and inside of the bottom of cover member 6 at sections in close proximity to window 6*b* instead of reflecting plate 35.

In addition, cover member 6 may be molded from a metal or plastic having high reflection efficiency, and the inside of the front, inside of the top and inside of the bottom of cover member 6 at sections in close proximity to window 6*b* may be formed to function as a reflecting means.

As a result of this type of construction, light from light emitting diode 16 can be reflected by reflecting plate (reflecting means) 35 to efficiently illuminate number wheels 4 and 5. Accordingly, the count displayed by number wheels 4 and 5 can be read easily even if there is only a single light emitting diode.

Electromagnetic connection terminals 2*a*, which supply electrical power to electromagnetic 2, and light emitting diode connection terminals (projections) 31, on the end of wiring pattern 32 in mounting board 30, protrude to the rear of cover member 6 through back section 7*a* of frame member 7.

Accordingly, in the case of attaching electromagnetic counter B to installation board 21 in which wiring pattern 22 is formed, as shown in FIG. 3, electromagnet connection terminals 2*a* and light emitting diode connection terminals 31 are inserted into through holes 25 provided in wiring pattern 22 of installation board 21, and while in this state, are automatically fed to a flow soldering device. As a result of this automatic soldering, the sections of these connection terminals 2*a* and 31 that protrude to the back of installation board 21 to wiring pattern 22 of installation board 21, installation board 21 can be easily assembled with electromagnetic counter B.

Figure 8:
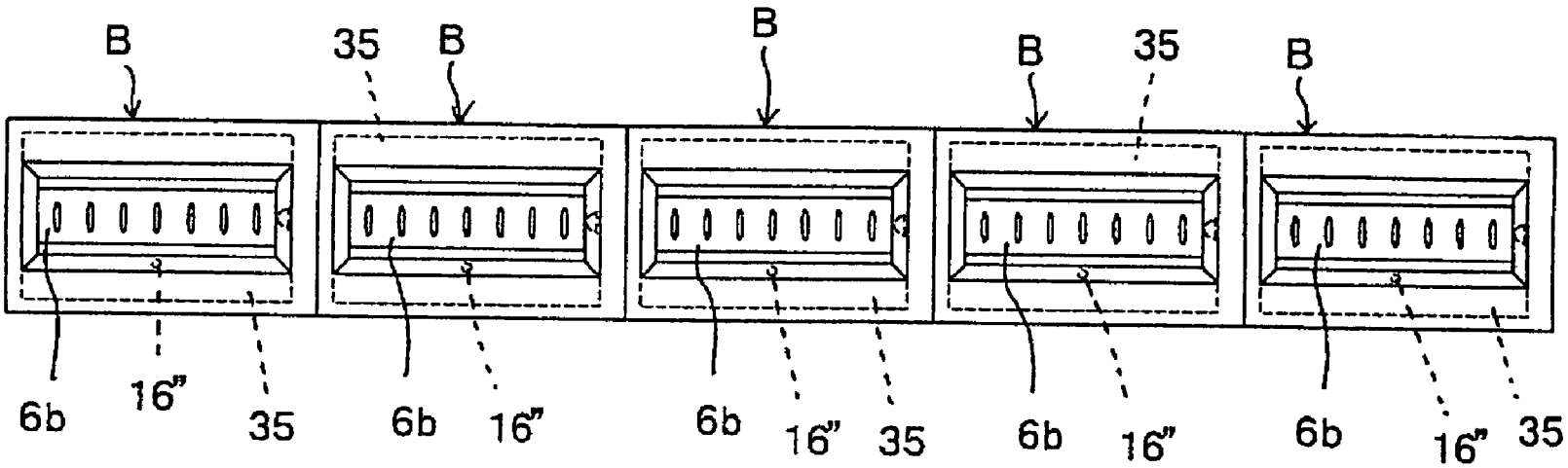
FIG. 8 is a front view showing the state in which a plurality of electromagnetic counters is installed.

Assembly work by automatic soldering in this manner is extremely useful such as in cases in which a plurality of electromagnetic counters B are installed collectively to accommodate a plurality of counted elements as shown in FIG. 8.

Figure 9:
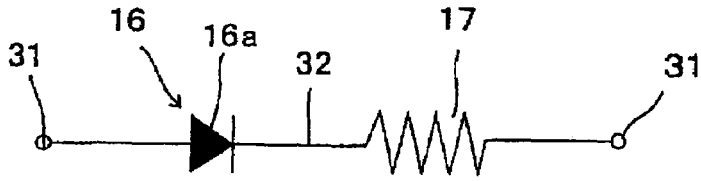
FIGS. 9(*a*), 9(*b*) and 9(*c*) are circuit diagrams depicting the circuit which is provided on a mounting board, wherein FIG. 9(*a*) represents the case of mounting a monochromatic light emitting diode, FIG. 6(*b*) is the case of mounting a two-color light emitting diode, and FIG. 6(*c*) is the case of mounting a three-color light emitting diode.
Figure 9:
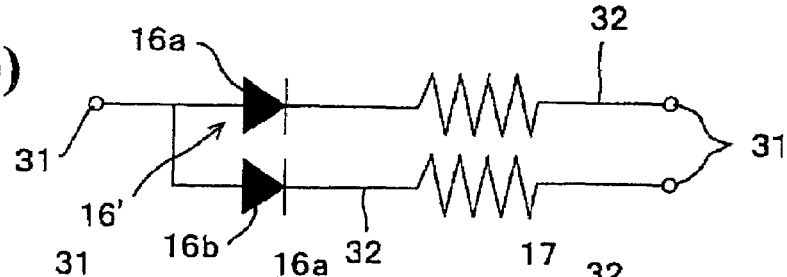
Figure 9:
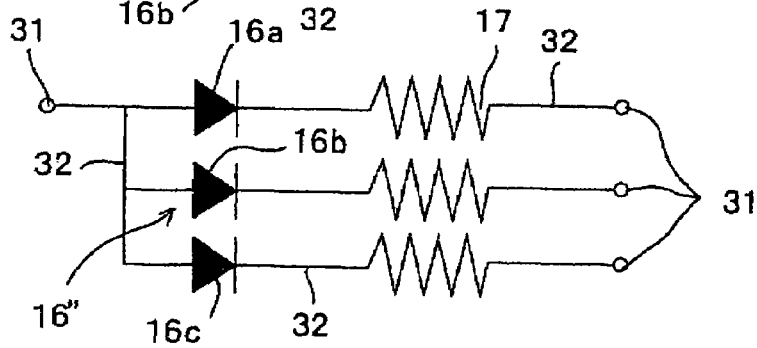

FIGS. 9(*a*) to 9(*c*) show examples of variations of light emitting diode 16 in the aforementioned embodiments.

In the electromagnetic counter B according to this embodiment, although a monochromatic light emitting diode provided with a single light emitting element 16*a* may be used with a circuit configuration such as that shown in FIG. 9(*a*) for light emitting diode 16 mounted on board 30, a multicolored light emitting diode 16' provided with two light emitting elements 16*a* and 16*b* having different colors may be used so as to have the circuit configuration shown in FIG. 9(*b*), or a multicolored light emitting diode 16" provided with three light emitting elements 16*a*, 16*b* and 16*c* having three different colors may be used to as to have the circuit configuration shown in FIG. 9(*c*).

In the case of using these multicolored light emitting diodes 16' and 16", by allowing one or a plurality of the light emitting elements of an arbitrary color or colors to light by suitably setting the voltage applied to light emitting diode connection terminals (projections) 31 on the end of wiring pattern 32, the emitted light (illumination color) can be suitably selected according to multicolored light emitting diodes 16' and 16".

As a result of this type of construction, by changing the emitted color of multicolored light emitting diode 16" for each electromagnetic counter B in FIG. 8, each electromagnetic counter B can be easily distinguished thereby making it possible to attenuate/eliminate reading errors for each counted element, improve the accuracy of count data and enable counting work to be carried out easily with a high degree of reliability.

The following provides an explanation of a visual test as relating to the reading of counts.

EXAMPLES

When light emitting diode 16 was induced to emit light by applying a current of 6 mA using electromagnetic counter B shown in FIGS. 4 to 7(*b*), the entire display section became bright due to the reflection effects produced by reflecting plate 35, and all digits of the count displayed by each number wheel 4 and 5 were able to be read.

In addition, when light emitting diode 16 was illuminated by applying a current of 18 mA, the entire display section became even brighter, and all digits of the count were able to be read more distinctly.

Comparative Example

Light emitting diode 16 was illuminated as in the above examples with the exception that the reflecting plate 35 was removed. In the case of a current of 6 mA, only the count of number wheel 5 located in close proximity to light emitting diode 16 was able to be read and the entire display section was poorly illuminated rendering it difficult to read the counts displayed by the other number wheels. In addition, in the case of a current of 18 mA, although all digits of the count could be read, since the count of number wheel 5 located in close proximity to light emitting diode 16 was excessively bright, it was difficult to accurately read the entire count.

The efficacy of the present invention was therefore able to be confirmed on the basis of these results.

Although the previous descriptions have provided an explanation of embodiments of the present invention with reference to the drawings, in the electromagnetic counter A arrangement, a flexible board can be used for mounting board 30, flexible board 15 (or mounting board 30) can be disposed at a location similar to the second embodiment, or a reflecting means can be additionally provided. In addition, in electromagnetic counter B arrangement, a mounting board 30 can be used for flexible board 15, mounting board 30 (or flexible board 15) can be disposed at a location similar to the first embodiment, or reflectivity can be imparted in the same manner as the first embodiment to each of the numbers 0 to 9 on the peripheral surface of each number wheel 4 and 5. In addition, the electromagnetic counter A type of arrangement can employ a construction such as disclosed in connection with FIGS. 6 to 9(*c*).

It should be appreciated that the present invention is not limited to the embodiments of the electromagnetic counter with built-in illumination means that have been disclosed above and the that various modifications and variations which can be made without departing from the scope and spirit of the invention will be self-evident to the person of skill in the art to which the invention pertains or most closely pertains given the preceding disclosure.

The disclosure of Japanese Patent Application No. 2005-192225 filed on Jun. 30, 2006 is incorporated as a reference.

What is claimed is:

1. An electromagnetic counter with built-in illumination comprising:

a frame member;

a cover member with a window for enclosing the frame member;

an electromagnetic counting mechanism mounted on the frame member and including an electromagnet, an anchor that is rotated by magnetization and demagnetization of the electromagnet, and a plurality of number wheels at least one of which is configured to rotate through a predetermined angle in response to rotation of the anchor, said electromagnetic counting mechanism mounted on the frame member being disposed in the cover member so that each of the number wheels is exposed to the window provided in the cover member to form a display section and a count displayed by each number wheel is visible through the window;

a light emitting diode for illuminating the display section and a wiring pattern for supplying electric power to the light emitting diode;

a mounting board on which the light emitting diode is mounted, and on which the wiring pattern is formed, said mounting board being arranged in a space between the frame member and the cover member so that the light emitting diode is positioned in the vicinity of the number wheels; and a reflective surface to render the numbered wheels readily readable when illuminated by the light emitting diode, the reflective surface being provided on at least one of an internal surface of the cover member and configured with respect to the window of the cover member to reflect light from the light emitting diode toward the numbered wheels, a periphery of at least one of the numbered wheels, and indicia formed in the numbered wheels.

2. An electromagnetic counter with a built-in illumination means according to claim 1, wherein the cover member is box-shaped.

3. An electromagnetic counter with a built-in illumination means according to claim 1, wherein the reflective surface on the internal surface of the cover member comprises a reflector.

4. An electromagnetic counter with a built-in illumination means according to claim 1, wherein the reflector comprises a reflecting plate provided on a surface around the window and inside the cover member.

5. An electromagnetic counter with a built-in illumination means according to claim 1, wherein the reflector comprises one of a metal-plated film and a reflective coated film formed on a surface around the window and inside the cover member.

6. An electromagnetic counter with a built-in illumination means according to claim 1, wherein the cover member comprises one of a molded metal and a molded plastic having high reflection characteristics, and a surface around the window and inside the cover member is configured to function as the reflective surface.

7. An electromagnetic counter with a built-in illumination means according to claim 6, wherein the cover member is box-shaped.

8. An electromagnetic counter with a built-in illumination means according to claim 1, wherein:

the cover member has a rear opening for inserting the frame member into the cover member, the frame member has a U-shape when viewed from above in which side sections are provided extending to the left and right edges of a back section that covers the rear opening, and the electromagnetic counting mechanism is disposed in a space enclosed by the back section and left and right side sections.

9. An electromagnetic counter with a built-in illumination means according to claim 8, further comprising:

electromagnet connection terminals that supply electrical power to the electromagnet, and light emitting diode connection terminals on the end of the wiring pattern on the mounting board, which respectively protrude out of a rear of the cover member through the back section.

10. An electromagnetic counter with a built-in illumination means according to claim 1, wherein the mounting board is integrally provided with projections that form the light emitting diode connection terminals, and the wiring pattern is formed over the light emitting diode mounted on the mounting board and the projection.

11. An electromagnetic counter with a built-in illumination means according to claim 1, wherein the light emitting diode is a multi-colored light emitting diode.

12. An electromagnetic counter with a built-in illumination means according to claim 9, wherein the connection terminals for the electromagnet and the connection terminals for the light emitting diode which protrude out of the rear cover of the cover member are configured to extend through through-holes provided in an installation board and to be connected to an installation board wiring pattern formed on the installation board.

* * * * *